United States Patent [19]

Saintsing et al.

[11] Patent Number: 4,648,413

[45] Date of Patent: Mar. 10, 1987

[54] ADJUSTABLE-DELIVERY CIGARETTE

[76] Inventors: Barry L. Saintsing, Rte. 8, Box 399, Lexington, N.C. 27292; Douglas C. Clark, 5120 Angelia Dr., Winston-Salem, N.C. 27106; John D. Weber, 6878 Brechenridge La., Clemmons, N.C. 27012

[21] Appl. No.: 587,325

[22] Filed: Mar. 7, 1984

[51] Int. Cl.[4] ..... A24D 3/04

[52] U.S. Cl. ..... 131/336; 131/198.1; 131/198.2

[58] Field of Search ..... 131/336, 198 R, 198 A, 131/198.1, 198.2

[56] References Cited

U.S. PATENT DOCUMENTS

| | | | |
|---|---|---|---|
| 2,269,995 | 1/1942 | Trane . | |
| 2,841,153 | 7/1958 | Pelletier | 131/336 |
| 2,936,763 | 5/1960 | Saffir . | |
| 3,057,360 | 10/1962 | Bugge . | |
| 3,511,247 | 5/1970 | Tamol . | |
| 3,526,904 | 9/1970 | Tamol . | |
| 3,547,134 | 12/1970 | Dock . | |
| 3,596,665 | 8/1971 | Lindgard . | |
| 3,699,973 | 10/1972 | Tamol et al. . | |
| 3,705,588 | 12/1972 | Tamol et al. . | |
| 4,219,030 | 8/1980 | Hall | 131/336 |
| 4,526,183 | 7/1985 | Nichols et al. . | |
| 4,527,573 | 7/1985 | Hauserman . | |

FOREIGN PATENT DOCUMENTS

| | | |
|---|---|---|
| 105682 | 4/1984 | European Pat. Off. . |
| 105683 | 4/1984 | European Pat. Off. . |
| 100215 | 6/1984 | European Pat. Off. . |

*Primary Examiner*—V. Millin

[57] ABSTRACT

An adjustable-delivery cigarette and method for producing same, whose strength delivery may be altered by the consumer in a range between higher and lower values. The cigarette includes a tobacco rod, with paper wrapper, and the filter assembly. An overwrap encircles the filter element and may also join the filter element to the tobacco rod. The overwrap has an adjustment zone formed therein, which may be in the form of a circumferential slot. The circumferential slot may extend partially through the overwrap, or may extend completely through the overwrap and partially through the filter plugwrap. In the latter instance, the filter plugwrap should be relatively impervious to airflow. Application by the consumer of a bending moment to the filter assembly results in the adjustment zone being ruptured, allowing a greater degree of air dilution, resulting in a decreased perceptible strength to the consumer. This adjustable-delivery cigarette can be manufactured conveniently using laser apparatus known to the art, modified and adjusted to achieve the desired levels of penetration.

8 Claims, 5 Drawing Figures

ADJUSTABLE-DELIVERY CIGARETTE

BACKGROUND OF THE INVENTION

This invention relates to smoking articles, and more particularly to smoking articles offering the consumer a choice between selectable levels of strength.

The cigarette industry has evolved from a condition in which most popular cigarettes generally offered consumers the same level of strength to a position in which consumers may choose from a wide variety of products of different strength levels. Products now on the market range from relatively strong, unfiltered cigarettes to products having extremely low strength deliveries. Although an individual consumer usually chooses one product within this range, studies have demonstrated that consumers would prefer the ability to choose different strength levels under different circumstances. For example, a person may prefer a stronger product following a meal, but desire lighter strength levels for the remainder of the day. At present, the only means available for a consumer to exercise such preference is to purchase several packages of entirely different products. Obviously, that choice is cumbersome and economically disadvantageous.

The cigarette industry long has sought to satisfy this demand by offering a product allowing for adjustment of strength delivery. The only design permitting such a product to be made with normal manufacturing methods is that disclosed in co-pending U.S. patent application Ser. No. 436,217 to Leslie E. Payne, commonly co-assigned with the present application. References cited in that application point up the manufacturing problems inherent in the prior art.

Indeed, the very fact that no manufacturer has offered an adjustable-delivery product on a national scale eloquently testifies to the industry's failure to meet existing demand.

The present design offers an adjustable-delivery product manufacturable with minimum alteration to existing equipment. For the first time, the industry will be able to present consumers with the real possibility of an adjustable-delivery cigarette.

SUMMARY OF THE INVENTION

The broad object of the present invention is to provide a smoking article capable of adjustment between two or more levels of strength delivery.

Another object of this invention is to provide a cigarette whose strength delivery level can be easily adjusted by the consumer.

Yet another object of this invention is to provide an adjustable-delivery cigarette manufacturable with minimum alteration to existing equipment.

A further object of the present invention is to provide a method for manufacturing an adjustable-delivery cigarette.

Yet another object of the invention is to provide a method for producing an adjustable-delivery cigarette utilizing conventional manufacturing apparatus to the maximum extent.

These and other objects are accomplished by the present invention, providing an adjustable-delivery cigarette. This product includes a tobacco rod, with paper wrapper, and a filter assembly. An overwrap encircles the filter element and may also join the filter element to the tobacco rod. This overwrap has an adjustment zone formed therein, which may be in the form of a circumferential slot. The filter assembly may have a conventional plugwrap, in which instance the adjustment zone extends partially through the overwrap. It is preferred, however, to employ a plugwrap relatively impervious to airflow, with the adjustment zone then extending completely through the overwrap and partially through the plugwrap. When a bending moment is applied to the filter element by the consumer, the adjustment zone ruptures, allowing a greater dilution of the mainstream smoke and resulting in lowered strength delivery.

Thus, the product offers a range of delivery levels, extending from a relatively higher strength delivery before adjustment to a relatively lower strength delivery after the adjustment zone is completely ruptured. By varying the bending moment applied to the filter element, a consumer may achieve delivery levels within this range.

A convenient means for producing the present adjustable-delivery cigarette would be to utilize laser apparatus known to the art, adjusted such that the laser achieves only the desired degree of penetration.

DETAILED DISCUSSION OF A PREFERRED EMBODIMENT

Figure 1:
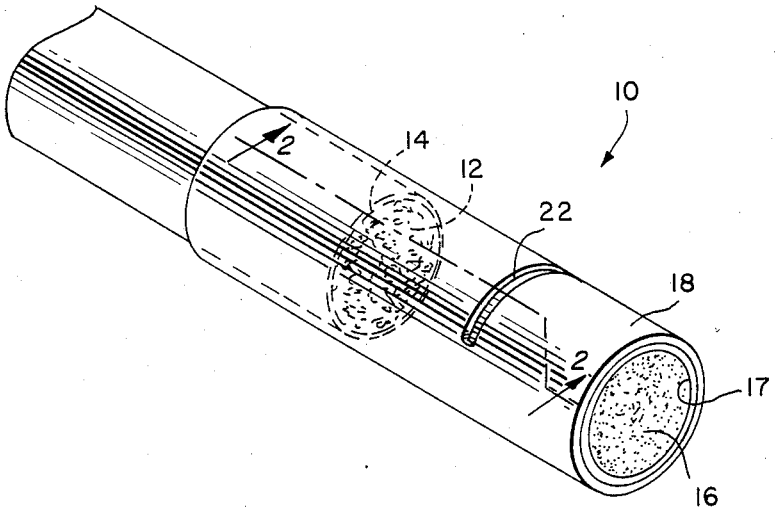
FIG. 1 is a pictorial of an embodiment of the invention.

FIG. 1 shows an embodiment 10 of the present invention. There, a tobacco rod 12 is abutted to a filter element 16 as is known in the art. The tobacco rod may be of any desired blend constituency. Similarly, the filter element may be fabricated of cellulose acetate or other convenient material known to the art. As is also known to the art, filter element 16 is encircled by a layer of plugwrap material 17, which layer is relatively impervious to the flow of air. It should be noted that if it is desired to fabricate filter element 16 of any of the various extruded materials known to the art, provision should be made in the extrusion process for the formation of a relatively impervious layer or "skin" corresponding to the plugwrap 17.

Figure 2:
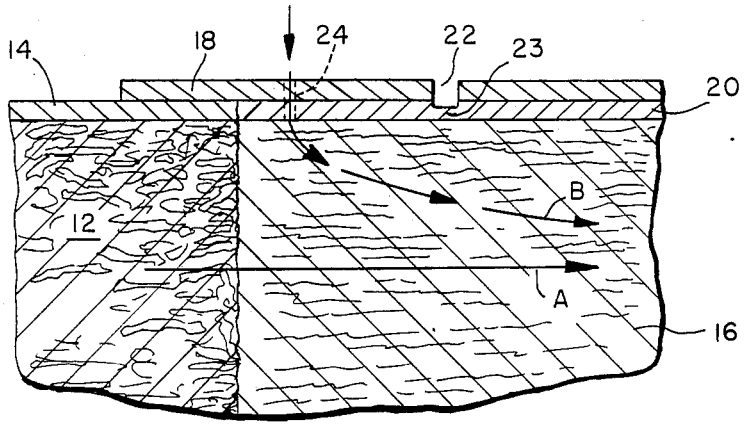
FIG. 2 is a detailed closeup of a cross-sectional side view of the embodiment of FIG. 1, taken on Plane 2—2, shown in FIG. 1.

As may be seen in greater detail in FIG. 2, the entire filter element/plugwrap assembly is encased by an overwrap 18, which may be conventional tipping paper. If it is desired to utilize this overwrap to join the filter element to the tobacco rod, as is known in the art, the overwrap may overlap the rearward end of the tobacco rod, as seen in FIG. 2.

An adjustment zone 22 is formed in the overwrap. It is preferred to form the adjustment zone as a circumferential slot, perpendicular to the long axis of the cigarette, as shown in FIG. 1. As may be seen in FIG. 2, the adjustment zone is a slot, passing completely through the overwrap, but only partially penetrating the plugwrap. A convenient means of forming the adjustment zone is to utilize a laser, which may be a laser of the type used in the art for effecting air dilution perforations. Those skilled in the art will appreciate the adjustments required to achieve the desired effect. It is preferred to form the adjustment zone as a circumferential slot, 10–15 mm. long, extending completely through the overwrap yet only scoring the plugwrap. The width of this slot depends upon the forms of the laser lens. With conventional apparatus, a slot of approximately 0.4 mm. surface width is formed. The slot tapers inward with increasing depth.

A variation upon the preferred embodiment of FIGS. 1 and 2 would be to employ conventional, relatively porous, plugwrap. In that instance, the adjustment zone would extend only partially through the overwrap. In all other regards, the variant would be identical to the preferred embodiment.

Air dilution perforations 24 may also be formed, extending completely through the overwrap and through the plugwrap, as explained below. These perforations could be formed wth a second laser apparatus, as would be obvious to those in the art. If the variant embodiment described above were employed, such perforations could be pre-formed using known mechanical or electrostatic perforating apparatus. Such perforations are used in the art to set a desired strength level, and they could be used in the present invention to establish the pre-adjustment strength level. Those in the art will understand that such perforations are normally microscopic in size and that the size of perforation 24 in FIG. 2 has been exaggerated for clarity. Such perforations are used in the art to set a desired strength level, and they could be used in the present invention to establish the pre-adjustment strength level. The number, size, and spacing of such perforations can be selected by those in the art to achieve a desired level of pre-adjustment air dilution.

Those in the art will appreciate that a primary means used to determine the perceived "strength" delivered by a cigarette is the amount of air dilution. High "strength" products will have little or no air dilution; the smoke delivered to the consumer will be primarily that flowing through the mainstream, shown by arrow A.

Figure 3:
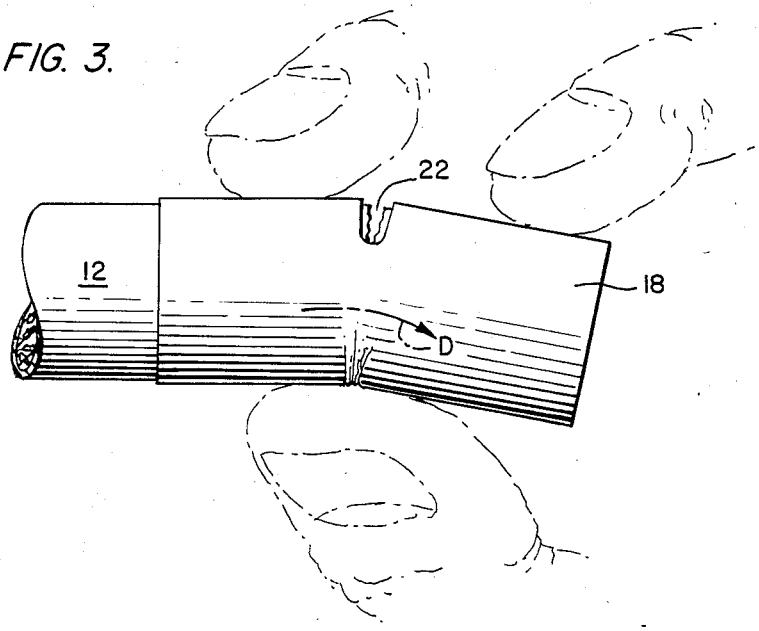
FIG. 3 is a side view of the embodiment shown in FIG. 1, after adjustment of delivery level.

Operation of the invention will be enhanced by an understanding of the airflow patterns within a conventional cigarette. Airflow within the present invention, before adjustment, is identical to that pattern. The primary airflow takes place in the mainstream, shown by arrow A in FIG. 2. The mainstream consists of air which has flowed through the tobacco rod, as well as any air flowing through the tobacco rod wrapper 14. A primary means by which the art sets the delivery level of a given product is through the provision of air dilution perforations, such as shown at 24 in FIG. 2. Airflow, shown by arrows B in FIG. 2, flows through such perforations and mixes with the mainstream to produce the final smoke mixture delivered to the consumer. Because the overwrap 18 and plugwrap 20 are relain the overwrap and plugwrap. Application of a bending moment to the filter element in the area of the adjustment zone, as depicted by arrow D in FIG. 3 results in the portion of the plugwrap remaining under the adjustment zone to rupture. The consumer can impart such a bending moment easily, for example, by placing a thumb on the filter element directly below the adjustment zone and placing one finger on the upper portion of the cigarette forward of the adjustment zone and one to the rear of the adjustment zone, as shown. Because only a portion of the plugwrap remains intact, a minimal amount of force is required to rupture the plugwrap.

Figure 4:
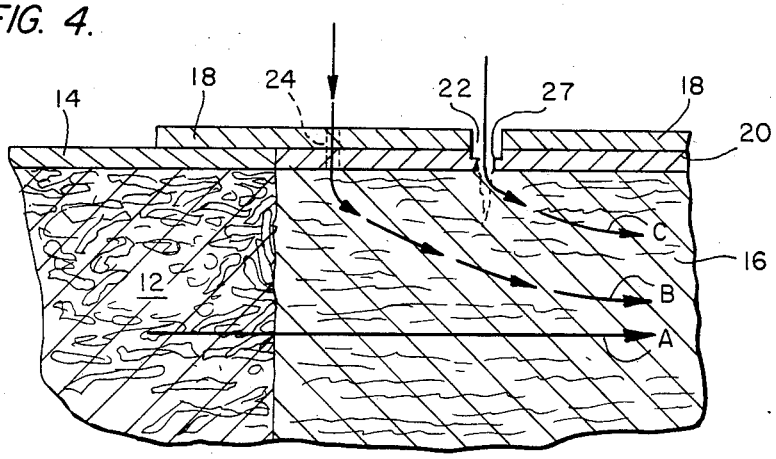
FIG. 4 is a detailed closeup of the embodiment of FIG. 1, taken on Plane 2—2, after adjustment of strength level.

When the natural resilience of the filter element causes the product to return to a straight configuration, the product's airflow pattern has been substantially altered. As shown in FIG. 4, the mainstream A and the perforation flow B are still present, but the ruptured plugwrap now admits an additional air dilution flow C. Because the air dilution has been increased, the product will now deliver smoke having a decreased strength, as perceived by the consumer.

Thus, this invention makes it possible to deliver a product having several selected strength levels. As delivered to the consumer, the product will be in the form shown in FIG. 2. Given an appropriate blend formulation in the tobacco rod and appropriate air dilution perforations 24, this product could be, for example, a cigarette having in the vicinity of 11 mgs. "tar". During periods in which the consumer desires a cigarette having this strength level, the product would be smoked as it is delivered in the pack in the form shown in FIGS. 1 and 2. After adjustment, however, the increased dilution could result, for example, in the product having a delivered strength in the vicinity of 6 mgs. "tar". When a consumer desires to reduce the level of perceived strength, he or she simply removes the product from the package, quickly and easily ruptures the strength barrier, and proceeds to consume the product in a normal manner.

It has been found that the amount of strength reduction is directly proportional to the length of the slot. With a slot about 13 mm. long, strength is reduced by about 42%, while a slot length of about 10 mm. produces a reduction of about 35%.

Figure 5:
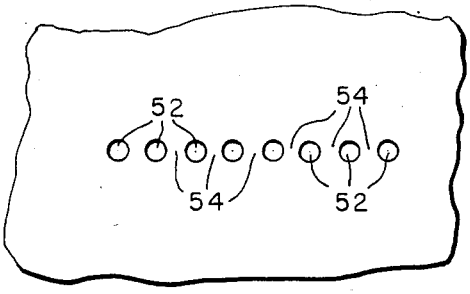
FIG. 5 is a detailed view showing a feature of an alternate embodiment of the invention.

Although it is preferred to form the adjustment slot in the manner described, other methods will be apparent to those skilled in the art. For example, FIG. 5 shows the result of a method wherein the laser is adjusted to form a series of circular apertures 52 in the overwrap, leaving narrow bridges 54 between each aperture. As with the previous embodiment, each such aperture extends completely through the overwrap, but only partially through the plugwrap. By selecting appropriate spacing between apertures 52, those skilled in the art can select the amount of bending moment (arrow D in FIG. 3) required to rupture the remaining material and achieve increased air dilution.

Other variations from the embodiments depicted will

We claim:

1. An adjustable-delivery cigarette having:

a tobacco rod;

a filter element, abutting said tobacco rod, having an outer layer relatively impervious to airflow; and an overwrap encircling said filter element, having formed therein a means for adjusting said delivery, said means comprising an adjustment zone, extending through said overwrap and partially penetrating said filter outer layer, such that the application of a bending moment to said filter element ruptures said outer layer within said adjustment zone.

2. The adjustable-delivery cigarette of claim 1, wherein said adjustment zone describes a circumferential arc on said overwrap, said arc being normal to the longitudinal axis of the cigarette.

3. The adjustable-delivery cigarette of claim 2, wherein said filter element includes:

a cylindrical filter; and a plugwrap encircling said filter, said plugwrap being relatively impervious to airflow.

4. The adjustable-delivery cigarette of claim 1, wherein said adjustment zone is a slot of selected length and depth.

5. The adjustable-delivery cigarette of claim 1, wherein said adjustment zone includes a plurality of spaced apertures.

6. A method of producing an adjustable-delivery cigarette, comprising the steps of:

abutting a tobacco rod to a filter element having an outer layer relatively impervious to airflow to form a cigarette;

wrapping the filter end of said cigarette with an overwrap; and forming an adjustment zone in said overwrap, said adjustment zone extending completely through said overwrap and partially through the outer layer of said filter element, such that the application of a bending moment to said filter element ruptures said outer layer of said filter element.

7. The method of claim 6, wherein said forming step includes:

cutting a circumferential slot transverse to the longitudinal axis of the cigarette.

8. The method of claim 6, wherein said forming step includes:

puncturing said overwrap in a pattern defining a circumferential arc transverse to the longitudinal axis of the cigarette.

* * * * *